US011766865B2

(12) United States Patent
Tamai et al.

(10) Patent No.: US 11,766,865 B2
(45) Date of Patent: Sep. 26, 2023

(54) LIQUID EJECTING HEAD AND LIQUID EJECTING APPARATUS

(71) Applicant: Seiko Epson Corporation, Tokyo (JP)

(72) Inventors: Shotaro Tamai, Matsumoto (JP); Takanori Aimono, Matsumoto (JP); Takahiro Katakura, Okaya (JP); Yuma Fukuzawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 18 days.

(21) Appl. No.: 17/653,066

(22) Filed: Mar. 1, 2022

(65) Prior Publication Data

US 2022/0281223 A1 Sep. 8, 2022

(30) Foreign Application Priority Data

Mar. 2, 2021 (JP) ..... 2021-032342

(51) Int. Cl.
*B41J 2/14* (2006.01)

(52) U.S. Cl.
CPC .. *B41J 2/14233* (2013.01); *B41J 2002/14491* (2013.01); *B41J 2202/12* (2013.01)

(58) Field of Classification Search
CPC ..... B41J 2/14233; B41J 2002/14491; B41J 2202/12; B41J 2002/14362; B41J 2/14201; B41J 2/14; B41J 2002/14459; B41J 2002/14483
See application file for complete search history.

(56) References Cited

U.S. PATENT DOCUMENTS

2019/0299615 A1* 10/2019 Sugiura ..... B41J 2/1623
2019/0329559 A1 10/2019 Ozawa

FOREIGN PATENT DOCUMENTS

JP 2018-103418 7/2018

* cited by examiner

*Primary Examiner* — Lisa Solomon
(74) *Attorney, Agent, or Firm* — WORKMAN NYDEGGER

(57) ABSTRACT

A liquid ejecting head includes: a nozzle array including nozzles via which liquid is to be discharged and which are arrayed in a first direction; a nozzle passage that leads to a nozzle and extends in a second direction intersecting the first direction; a first pressure chamber; a second pressure chamber disposed adjacent to the first pressure chamber in the first direction; a first communicating passage via which the first pressure chamber communicates with an interior of the nozzle passage and which extends in a third direction orthogonal to the first and second directions; and a second communicating passage via which the second pressure chamber communicates with the interior of the nozzle passage and which extends in the third direction. As viewed from the second direction, an inner wall surface of the first communicating passage positioned on a side of the second communicating passage includes a first inclined surface that extends in a fourth direction intersecting the first and third directions.

14 Claims, 10 Drawing Sheets

LIQUID EJECTING HEAD AND LIQUID EJECTING APPARATUS

The present application is based on, and claims priority from JP Application Serial Number 2021-032342, filed Mar. 2, 2021, the disclosure of which is hereby incorporated by reference herein in its entirety.

BACKGROUND

1. Technical Field

The present disclosure relates to a liquid ejecting head and to a liquid ejecting apparatus equipped with such a liquid ejecting head.

2. Related Art

Some liquid ejecting heads known in the art drive pressurizing devices such as piezoelectric elements to apply pressure to the liquid contained in a pressure chamber, thereby discharging the liquid to the outside via nozzles. For example, JP-A-2018-103418 discloses a liquid ejecting head that includes: a nozzle array; and two pressure chambers that lead to a nozzle and are arranged side by side in a direction intersecting the nozzle array.

If a plurality of pressure chambers leading to a nozzle are arranged along a nozzle array in contrast to the above liquid ejecting head, bubbles may be generated and remain around a bulkhead disposed inside a communicating passage via which the pressure chambers communicate with each other. In this case, the liquid ejecting head might fail to discharge the liquid efficiently.

SUMMARY

According to an aspect of the present disclosure, a liquid ejecting head includes: a nozzle array including a plurality of nozzles via which liquid is to be discharged, the nozzles being arrayed in a first direction; a nozzle passage that leads to a predetermined nozzle out of the plurality of nozzles and that extends in a second direction intersecting the first direction; a first pressure chamber in which pressure is applied to the liquid; a second pressure chamber in which pressure is applied to the liquid and which is disposed adjacent to the first pressure chamber in the first direction; a first communicating passage via which the first pressure chamber communicates with an interior of the nozzle passage and which extends in a third direction intersecting both the first direction and the second direction at substantially right angles; and a second communicating passage via which the second pressure chamber communicates with the interior of the nozzle passage and which extends in the third direction. As viewed from the second direction, an inner wall surface of the first communicating passage positioned on a side of the second communicating passage includes a first inclined surface that extends in a fourth direction intersecting both the first direction and the third direction.

According to another aspect of the present disclosure, a liquid ejecting apparatus includes: the above liquid ejecting head; and a controller that controls a liquid ejecting operation of the liquid ejecting head.

DESCRIPTION OF EXEMPLARY EMBODIMENTS

Some embodiments of the present disclosure will be described below with reference to the accompanying drawings. It should be noted that the sizes and scales of components in each drawing may be different from actual ones. Those embodiments are preferred, concrete examples with appropriate technical limitations. Therefore, the present disclosure is not limited to the embodiments unless otherwise specified.

1. First Embodiment

Figure 1:
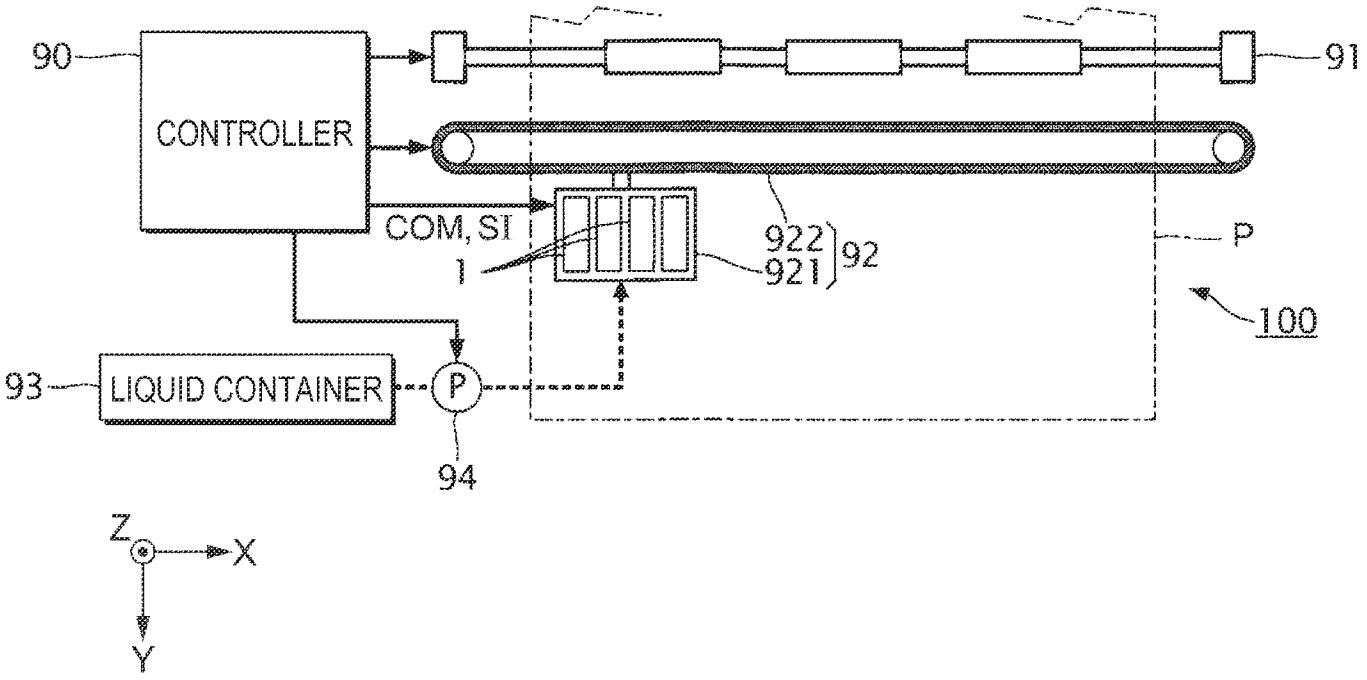
FIG. 1 schematically illustrates a configuration of a liquid ejecting apparatus according to a first embodiment of the present disclosure.

With reference to FIG. 1, a description will be given below of a liquid ejecting apparatus 100 according to a first embodiment of the present disclosure.

FIG. 1 schematically illustrates a configuration of the liquid ejecting apparatus 100 according to the first embodiment. The liquid ejecting apparatus 100 may be an ink jet printer that discharges liquid such as ink onto a medium P. The medium P may be a print paper, a resin film, a fabric sheet, and other material.

As illustrated in FIG. 1, the liquid ejecting apparatus 100 includes a liquid container 93 that contains ink. Examples of the liquid container 93 include a cartridge attachable to or detachable from the liquid ejecting apparatus 100, a bag-shaped ink pack made of a flexible film, and an ink refillable tank. The liquid container 93 may contain different color inks.

The liquid ejecting apparatus 100 further includes a controller 90, a moving mechanism 91, a transport mechanism 92, and a circulation mechanism 94. The controller 90, which includes: a processing circuit such as a central processing unit (CPU) or a field-programmable gate array (FPGA); and a memory circuit such as semiconductor memory, controls the operations of components constituting the liquid ejecting apparatus 100.

The moving mechanism 91 feeds the medium P in the +Y direction under the control of the controller 90. Hereinafter, any of the ±Y directions, which are opposite to each other, are referred to as the Y-axial direction.

The transport mechanism 92 moves a plurality of liquid ejecting heads 1 in the ±X directions, which are opposite to each other, under the control of the controller 90. Hereinafter, any of the ±X directions is referred to as the X-axial direction. The X-axial direction intersects the Y-axial direction, for example, at right angles. The transport mechanism 92 includes: a storage case 921; and an endless belt 922 to which the storage case 921 is fixed. The storage case 921 houses the plurality of liquid ejecting heads 1 arranged side by side in the X-axial direction, with their long sides extending in the Y-axial direction. In addition to the liquid ejecting heads 1, the liquid container 93 may further house the storage case 921.

The circulation mechanism 94 supplies the inks contained in the liquid container 93 to the liquid ejecting heads 1 via supply passages 53 (see FIG. 4), under the control of the controller 90. In addition, the circulation mechanism 94 collects inks that remain in ejection passages (see FIG. 4) disposed inside the liquid ejecting heads 1 and then resupplies the collected inks to the liquid ejecting heads 1 via the supply passages 53, under the control of the controller 90.

The controller 90 controls an ink ejecting operation of each liquid ejecting head 1. More specifically, the controller 90 transmits, to the liquid ejecting heads 1, drive signals COM for driving the liquid ejecting heads 1 and control signals SI for controlling the liquid ejecting heads 1. In accordance with the drive signals COM and under the control of the control signals SI, the liquid ejecting heads 1 discharges the inks in the −Z direction via a predetermined number of nozzles N (see FIG. 2) disposed therein. The −Z direction intersects both the X-axial direction and the Y-axial direction, for example, at right angles. Hereinafter, any of the ±Z directions, which are opposite to each other, is referred to as the Z-axial direction. In this embodiment, the +Z direction corresponds to the upward direction, whereas the −Z direction corresponds to the downward direction.

The liquid ejecting heads 1 discharge the inks via a predetermined number of nozzles N in relation to the feeding of the medium P by the moving mechanism 91 and the reciprocating movement of the liquid ejecting heads 1 by the transport mechanism 92. In this way, the liquid ejecting heads 1 place the inks on the surface of the medium P, thereby forming a desired image thereon. In this embodiment, the liquid ejecting apparatus 100 may be of a serial type that forms an image by causing the liquid ejecting heads 1 to reciprocate relative to the medium P.

Figure 2:
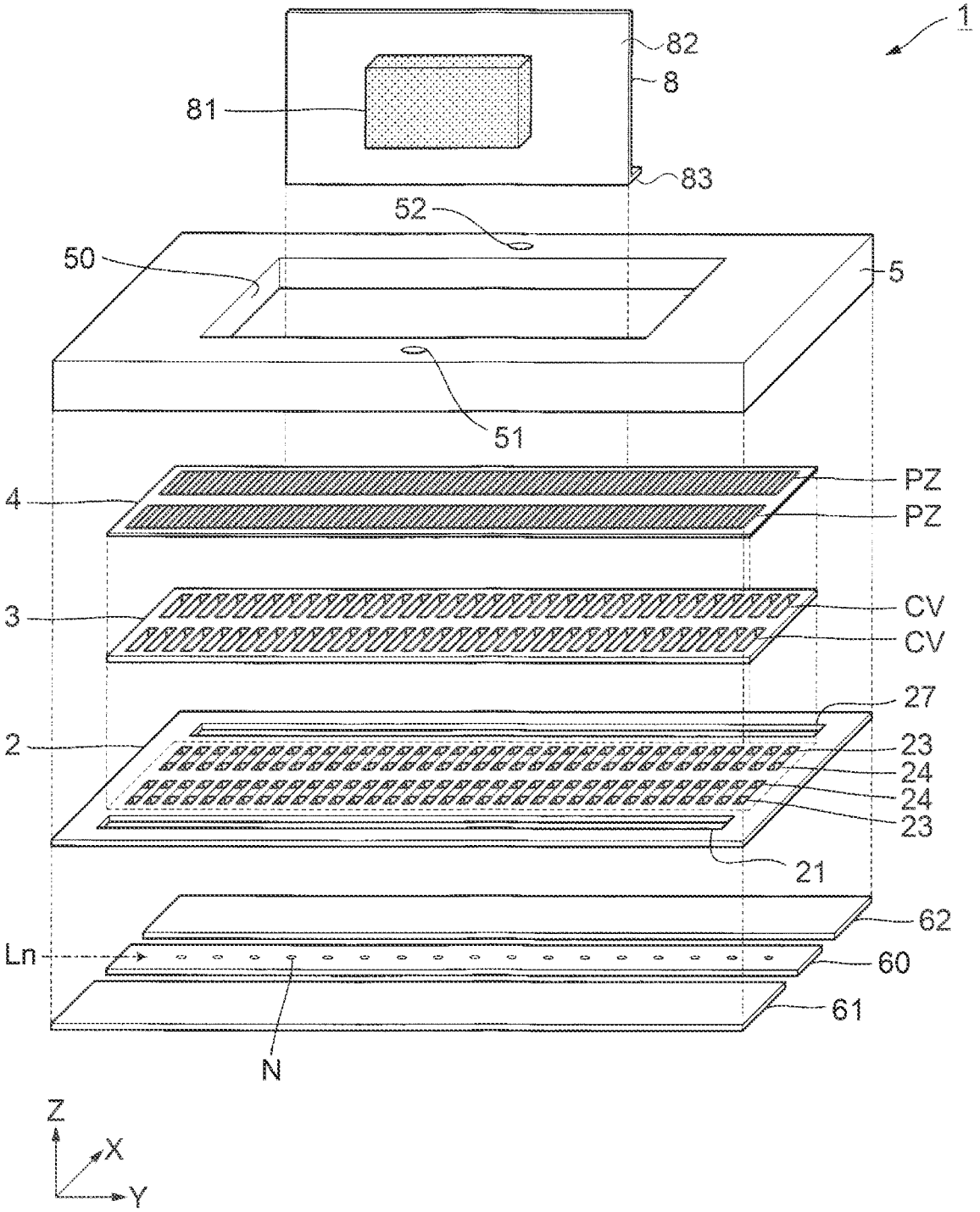
FIG. 2 is an exploded perspective view of the liquid ejecting head.
Figure 3:
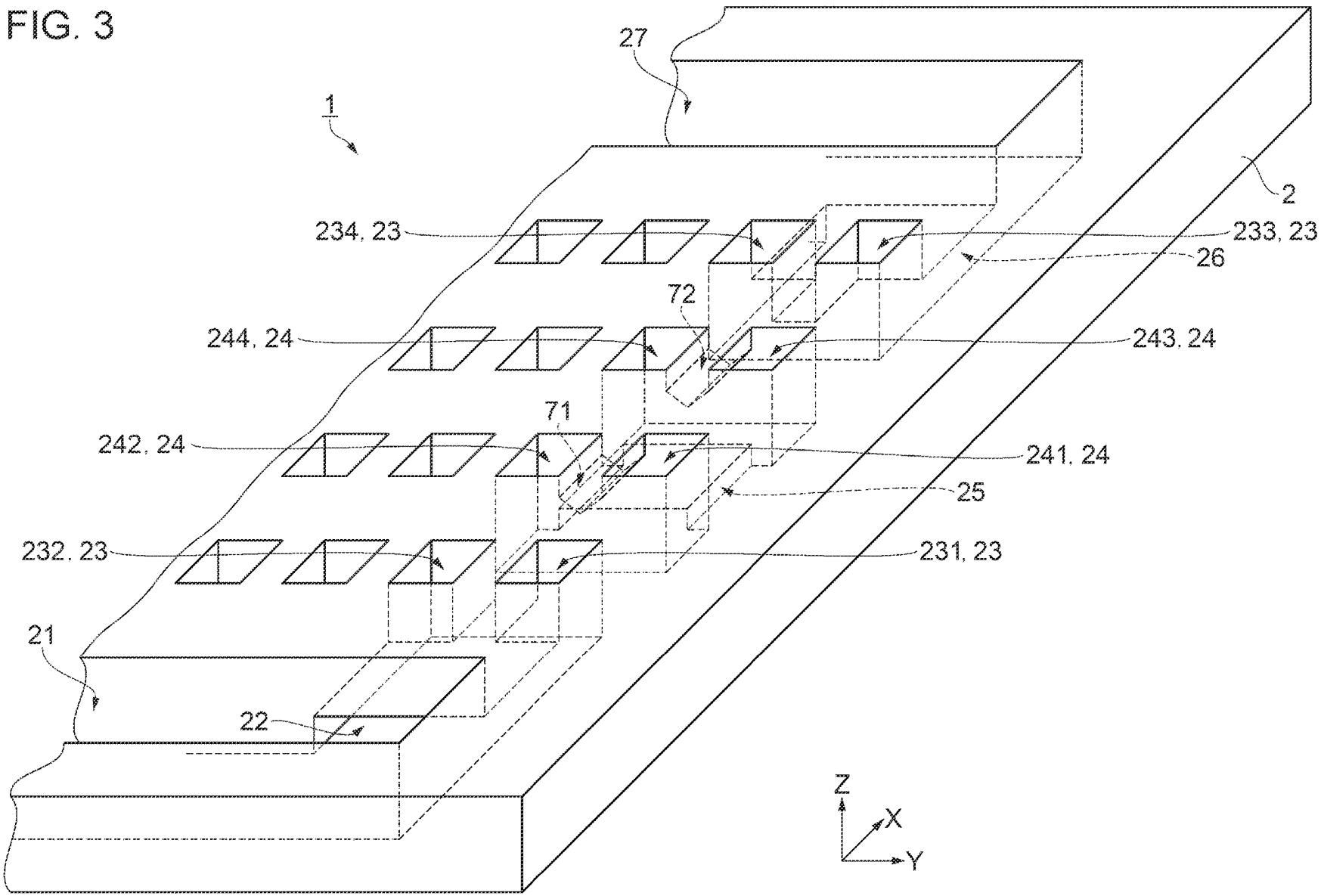
FIG. 3 is a schematic, perspective view of passages formed in the communicating board.
Figure 4:
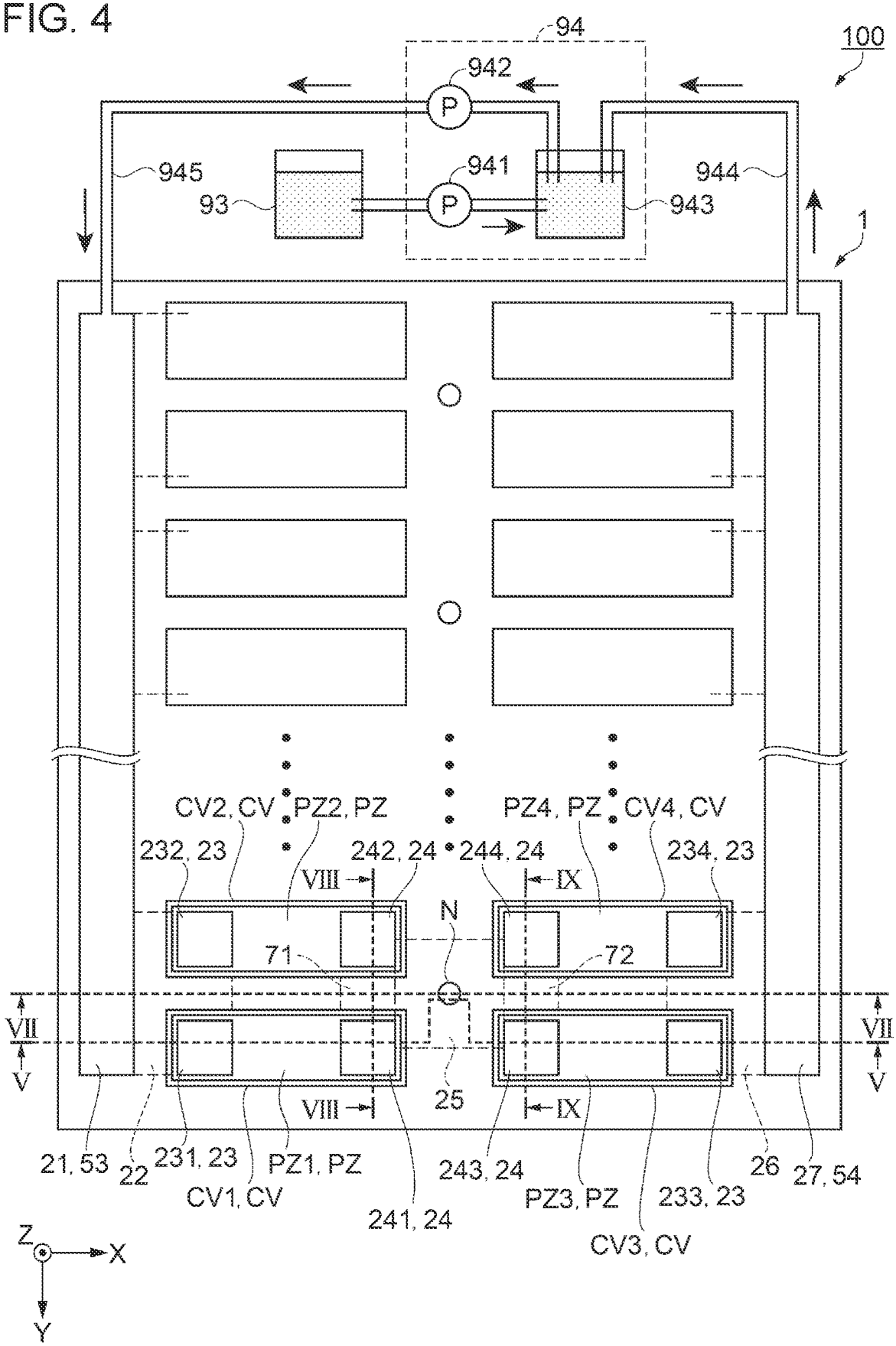
FIG. 4 schematically illustrates the passages and a circulation mechanism in the liquid ejecting apparatus.
Figure 5:
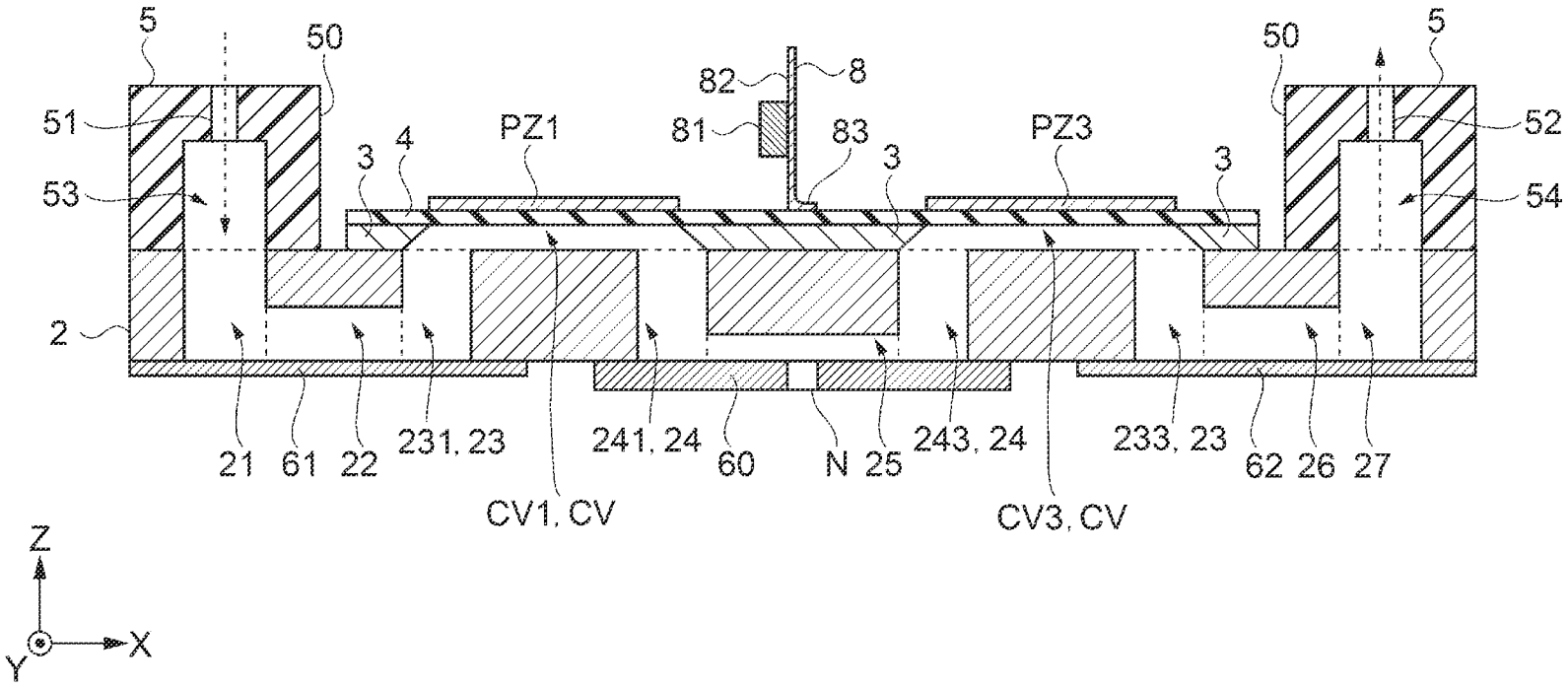
FIG. 5 is a cross-sectional view taken along line V-V of FIG. 4.

FIG. 2 is an exploded perspective view of a liquid ejecting head 1; FIG. 3 is a schematic, perspective view of passages formed in a communicating board 2; FIG. 4 schematically illustrates the passages and the circulation mechanism 94 in the liquid ejecting apparatus 100, more specifically, the passages in the liquid ejecting head 1 as viewed from the +Z direction; and FIG. 5 is a cross-sectional view taken along line V-V of FIG. 4. With reference to FIGS. 2 to 5 as appropriate, the outline of the liquid ejecting head 1 will be described below.

As illustrated in FIG. 2, the liquid ejecting head 1 includes the communicating board 2, a pressure chamber substrate 3, a vibration plate 4, a plurality of piezoelectric elements PZ mounted on the vibration plate 4, a reservoir forming substrate 5, a sealing member (not illustrated), a wiring substrate 8, a nozzle substrate 60, and compliance sheets 61 and 62.

On the +Z-directional side with respect to the communicating board 2, the pressure chamber substrate 3, the vibration plate 4, the piezoelectric elements PZ mounted on the vibration plate 4, the reservoir forming substrate 5, the sealing member, and the wiring substrate 8 are disposed. On the −Z-directional side with respect to the communicating board 2, the nozzle substrate 60 and the compliance sheets 61 and 62 are disposed. All of the components constituting the liquid ejecting head 1 may be sheet members with their long sides extending in substantially the Y-axial direction. Those components may be bonded together with glue.

As illustrated in FIG. 2, the nozzle substrate 60 is a sheet member on which a plurality of nozzles N are arrayed in the Y-axial direction to form a nozzle array Ln. The Y-axial direction may correspond to a first direction that will be described later. Each nozzle N may be a through-hole via which ink is to be discharged. The nozzle substrate 60 may be manufactured by subjecting a monocrystalline silicon substrate to a semiconductor manufacturing technique using a finishing process such as dry or wet etching. Alternatively, the nozzle substrate 60 may be manufactured as appropriate from any other known material with any other known method.

The communicating board 2 is mounted on the +Z-directional-side surface of the nozzle substrate 60. The communicating board 2 may be a sheet member on which ink passages are formed. As illustrated in FIG. 2 or 3, the communicating board 2 is provided with a supply passage 21, junction passages 22, coupling passages 23, communicating passages 24, nozzle passages 25, communicating passages 24, coupling passages 23, junction passages 26, and an ejection passage 27 in this order from the −X-directional to +X-directional side. These passages are coupled together by bonding together the above components of the liquid ejecting head 1, and ink flows in the liquid ejecting head 1 therethrough.

Each of the supply passage 21 and the ejection passage 27 in the communicating board 2 is a through-hole formed so as to extend in the Y-axial direction. The junction passages 22 are arrayed in the Y-axial direction. Likewise, ones of the coupling passages 23 which are positioned closer to the −X-directional side are arrayed in the Y-axial direction; ones of the communicating passages 24 which are positioned closer to the −X-directional side are arrayed in the Y-axial direction; the nozzle passages 25 are arrayed in the Y-axial direction; the remaining ones of the communicating passage 24, which are positioned closer to the +X-directional side, are arrayed in the Y-axial direction; the remaining ones of the coupling passages 23, which are positioned closer to the +X-directional side, are arrayed in the Y-axial direction; and the junction passages 26 are arrayed in the Y-axial direction. All of the junction passages 22, the nozzle passages 25, and the junction passages 26 are formed in the −Z-directional-side surface of the communicating board 2. In this case, each of the coupling passages 23 and the communicating passages 24 is a through-hole. The communicating board 2 may be manufactured in the same manner as the nozzle substrate 60 described above. More specifically, the communicating board 2 may be manufactured by subjecting a monocrystalline silicon substrate to a semiconductor manufacturing technique. However, the communicating board 2 may be manufactured as appropriate from any other known material with any other known method. In this embodiment, one junction passage 22 branches into two coupling passages 23; however, one junction passage 22 may branch into any other number of coupling passages 23 arrayed in the Y-axial direction. This example is also applicable to each junction passage 26.

The pressure chamber substrate 3 is mounted on the +Z-directional-side surface of the communicating board 2. The pressure chamber substrate 3 is a sheet member in which a plurality of pressure chambers CV are formed. As illustrated in FIG. 2, the plurality of pressure chambers CV are arrayed in two rows in the Y-axial direction. Each pressure chamber CV is a room, called a cavity, in which pressure is to be applied to ink. Each pressure chamber CV may be formed across the pressure chamber substrate 3 in the Z-axial direction while extending in the X-axial direction. The pressure chamber substrate 3 may be manufactured in the same manner as the nozzle substrate 60 described above. More specifically, the pressure chamber substrate 3 may be manufactured by subjecting a monocrystalline silicon substrate to a semiconductor manufacturing technique. However, the pressure chamber substrate 3 may be manufactured as appropriate from any other known material with any other known method.

The vibration plate 4 is mounted on the +Z-directional-side surface of the pressure chamber substrate 3. The vibration plate 4 may be an elastically deformable sheet member. The +Z-directional-side surface of the vibration plate 4 is provided with the piezoelectric elements PZ related to the respective pressure chambers CV. Each piezoelectric element PZ, which is elongated in the X-axial direction, is a passive element that deforms in response to a drive signal COM. The plurality of piezoelectric elements PZ are arrayed in two rows in the Y-axial direction in relation to the pressure chambers CV. When the vibration plate 4 vibrates in response to the deforming of a certain piezoelectric element PZ, the inner pressure of the pressure chamber CV related to the piezoelectric element PZ varies, forcing the ink to the outside via the corresponding nozzle N.

The reservoir forming substrate 5 is mounted on the +Z-directional-side surface of the communicating board 2. The reservoir forming substrate 5 may be a member having a long side extending in the Y-axial direction, in which ink passages are formed. More specifically, the reservoir forming substrate 5 includes a supply passage 53 and an ejection passage 54 (see FIG. 5). The supply passage 53 is coupled to the supply passage 21 in the communicating board 2 and formed near the −X-directional side of the reservoir forming substrate 5 while extending in the Y-axial direction. The ejection passage 54 is coupled to the ejection passage 27 in the communicating board 2 and formed near the +X-directional side of the reservoir forming substrate 5 while extending in the Y-axial direction.

As illustrated in FIGS. 2 and 5, the reservoir forming substrate 5 further includes: a supply port 51 leading to the supply passage 53; and an ejection port 52 leading to the ejection passage 54. When ink is supplied from the liquid container 93 to the liquid ejecting head 1, the ink flows into the supply passage 53 via the supply port 51. When the ink remains in the ejection passage 54, it is collected via the ejection port 52. Then, the ink collected via the ejection port 52 is returned to the liquid container 93 containing the inks. In this way, the ink is circulated in the liquid ejecting head 1 through the supply passage 53 and the ejection passage 54.

The reservoir forming substrate 5 further includes an aperture 50, in which the pressure chamber substrate 3, the vibration plate 4, the wiring substrate 8, and the sealing member (not illustrated) are mounted. The reservoir forming substrate 5 may be manufactured by subjecting a resin material to injection molding. However, the reservoir forming substrate 5 may be manufactured as appropriate from any other known material with any other known method.

As illustrated in FIG. 5, the compliance sheet 61 is mounted within the −X-directional-side area on the −Z-directional-side surface of the communicating board 2 so as to cover the supply passage 21, the junction passage 22, and the coupling passage 23. The compliance sheet 61, which may be made of an elastic material, absorbs varying pressures of ink in the supply passage 21, the junction passage 22, and the coupling passage 23. Likewise, the compliance sheet 62 is mounted within the +X-directional-side area on the −Z-directional-side surface of the communicating board 2 so as to cover the ejection passage 27, the junction passage 26, and the coupling passage 23. The compliance sheet 62, which may be made of an elastic material, absorbs varying pressures of ink in the ejection passage 27, the junction passage 26, and the coupling passage 23.

Next, with reference to FIGS. 3 to 5, a description will be given below of a configuration of the liquid ejecting head 1 according to this embodiment in which the ink is discharged via a predetermined nozzle N. Hereinafter, the configuration in which the ink is discharged via a nozzle N is referred to as the basic passage configuration, for the sake of convenience.

For better understanding of the basic passage configuration of the liquid ejecting head 1 according to this embodiment, the description will be focused on a section within the +Y-directional-side area. The basic passage configuration in this section includes four pressure chambers CV that lead to a nozzle N and are arrayed in two rows in the Y-axial direction in which the nozzle array Ln is formed. Out of these pressure chambers CV, two are disposed adjacent to each other within the −X-directional-side area, and the others are disposed adjacent to each other within the +X-directional-side area.

In this embodiment, the Y-axial direction corresponds to the first direction; the X-axial direction corresponds to a second direction; and the Z-axial direction corresponds to a third direction. In the description below, one of the Y-axial direction and the first direction, one of the X-axial direction and the second direction, and one of the Z-axial direction and the third direction will be used as appropriate.

A concrete description of the basic passage configuration in this embodiment will be given from the −X-directional to +X-directional side. This basic passage configuration includes: a junction passage 22 that is coupled to the supply passage 21 and extends in the X-axial direction; and two coupling passages 23 that are coupled to the junction passage 22 and each extend in the Z-axial direction (third direction). Out of the two coupling passages 23, one positioned closer to the +Y-directional side is referred to as a first coupling passage 231, and the other, which is positioned closer to the −Y-directional side of the first coupling passage 231, is referred to as a second coupling passage 232.

The interior of the first coupling passage 231 communicates with a pressure chamber CV extending in the X-axial direction (second direction). The pressure chamber CV with which the interior of the first coupling passage 231 communicates is referred to as a first pressure chamber CV1. The interior of the first coupling passage 231 communicates with the −X-directional area of the first pressure chamber CV1. Likewise, the interior of the second coupling passage 232 communicates with a pressure chamber CV positioned adjacent to the first pressure chamber CV1 in the Y-axial direction (first direction), more specifically, on the −Y-directional side and extends in the X-axial direction (second direction). The pressure chamber CV with which the interior of the second coupling passage 232 communicates is referred to as a second pressure chamber CV2. The interior of the second coupling passage 232 communicates with the −X-directional area of the second pressure chamber CV2.

The first pressure chamber CV1 communicates with the interior of a communicating passage 24 extending in the Z-axial direction (third direction). The communicating passage 24, the interior of which communicates with the first pressure chamber CV1, is referred to as a first communicating passage 241. The interior of the first communicating passage 241 communicates with the +X-directional area of the first pressure chamber CV1. Likewise, the second pressure chamber CV2 communicates with the interior a communicating passage 24 extending in the Z-axial direction (third direction). The communicating passage 24, the interior of which communicates with the second pressure chamber CV2, is referred to as a second communicating passage 242. The interior of the second communicating passage 242 communicates with the +X directional area of the second pressure chamber CV2.

Both of the first communicating passage 241 and the second communicating passage 242 are coupled to a nozzle passage 25 extending in the X-axial direction (second direction). The nozzle passage 25 extends in the X-axial direction (second direction), which intersects the Y-axial direction (first direction). In this case, the X-axial direction may intersect the Y-axial direction at any given angles, such as right angles, within the X-Y plane. Both of the first communicating passage 241 and the second communicating passage 242 are coupled to the −X-directional side of the nozzle passage 25.

As viewed from the Z-axial direction, the nozzle N is positioned at substantially the center, in the X-axial and Y-axial directions, of the nozzle passage 25 having a substantially rectangular shape. The "substantially the center" described herein does not necessarily have to be a perfect center and may be a location that contains some potential errors but can be permitted to be the center.

It can be said that the first communicating passage 241 via which the first pressure chamber CV1 communicates with the interior of the nozzle passage 25 extends in the Z-axial direction (third direction), which intersects both the Y-axial direction (first direction) and the X-axial direction (second direction) at substantially right angles. Likewise, the second communicating passage 242 via which the second pressure chamber CV2 communicates with the interior of the nozzle passage 25 extends in the Z-axial direction (third direction).

The nozzle passage 25 is coupled to two other communicating passages 24, both of which extend in the Z-axial direction (third direction). Out of the two communicating passages 24, one positioned closer to the +Y-directional side is referred to as a third communicating passage 243, and the other, which is positioned closer to the −Y directional-side of the third communicating passage 243, is referred to as a fourth communicating passage 244. Both of the third communicating passage 243 and the fourth communicating passage 244 are coupled to the +X-directional side of the nozzle passage 25.

The interior of the third communicating passage 243 communicates with a pressure chamber CV extending in the X-axial direction. The pressure chamber CV with which the interior of the third communicating passage 243 communicates is referred to as a third pressure chamber CV3. The interior of the third communicating passage 243 communicates with the −X directional area of the third pressure chamber CV3. Likewise, the interior of the fourth communicating passage 244 communicates with the pressure chamber CV extending in the Z-axial direction (third direction). The pressure chamber CV with which the interior of the fourth communicating passage 244 communicates is referred to as a fourth pressure chamber CV4. The interior of the fourth communicating passage 244 communicates with the −X directional area of the fourth pressure chamber CV4.

The third pressure chamber CV3 is positioned adjacent to the first pressure chamber CV1 in the X-axial direction (second direction), more specifically, on the +X-directional side of the first pressure chamber CV1. The fourth pressure chamber CV4 is positioned adjacent to the third pressure chamber CV3 in the Y-axial direction (first direction), more specifically, on the −Y-directional side of the third pressure chamber CV3.

It can be said that the third communicating passage 243 via which the third pressure chamber CV3 communicates with the interior of the nozzle passage 25 extends in the Z-axial direction (third direction), which intersects both the Y-axial direction (first direction) and the X-axial direction (second direction) at right angles. Likewise, the fourth communicating passage 244 via which the fourth pressure chamber CV4 communicates with the interior of the nozzle passage 25 extends in the Z-axial direction (third direction).

The third pressure chamber CV3 communicates with the interior of a coupling passage 23 extending in the Z-axial direction (third direction). The coupling passage 23, the interior of which communicates with the third pressure chamber CV3, is referred to as a third coupling passage 233. The interior of the third coupling passage 233 communicates with the +X-directional area of the third pressure chamber CV3. Likewise, the fourth pressure chamber CV4 communicates with the interior of the coupling passage 23 extending in the Z-axial direction (third direction). The coupling passage 23, the interior of which communicates with the fourth pressure chamber CV4, is referred to as a fourth coupling passage 234. The interior of the fourth coupling passage 234 communicates with the +X-directional area of the fourth pressure chamber CV4.

Both of the third coupling passage 233 and the fourth coupling passage 234 are coupled to a junction passage 26 extending in the X-axial direction. The junction passage 26 is coupled to the ejection passage 27.

As viewed from the Z-axial direction, the layout of the junction passage 22, the first coupling passage 231, the second coupling passage 232, the first communicating passage 241, the second communicating passage 242, the nozzle passage 25, the third coupling passage 233, the fourth coupling passage 234, and the junction passage 26 in this embodiment is substantially symmetric with respect to the nozzle N. The "substantially symmetric" does not necessarily have to be "perfectly symmetric" and may contain some potential error caused by distortion during etch forming as long as the error is within a permissible range.

The +Z-directional-side surface of the vibration plate 4 is provided with a first piezoelectric element PZ1 and a second piezoelectric element PZ2. The first piezoelectric element PZ1 faces the first pressure chamber CV1 in the +Z direction and extends in the X-axial direction; the second piezoelectric element PZ2 faces the second pressure chamber CV2 in the +Z direction and extends in the X-axial direction. Likewise, the +Z-directional-side surface of the vibration plate 4 is provided with a third piezoelectric element PZ3 and a fourth piezoelectric element PZ4. The third piezoelectric element PZ3 faces the third pressure chamber CV3 in the +Z direction and extends in the X-axial direction; the fourth piezoelectric element PZ4 faces the fourth pressure chamber CV4 in the +Z direction and extends in the X-axial direction.

The passage in the liquid ejecting head 1 includes, as constituting elements or units, a plurality of basic passage configurations described above, which are arrayed at predetermined intervals in the Y-axial direction, in accordance with the number of nozzles N.

Figure 6:
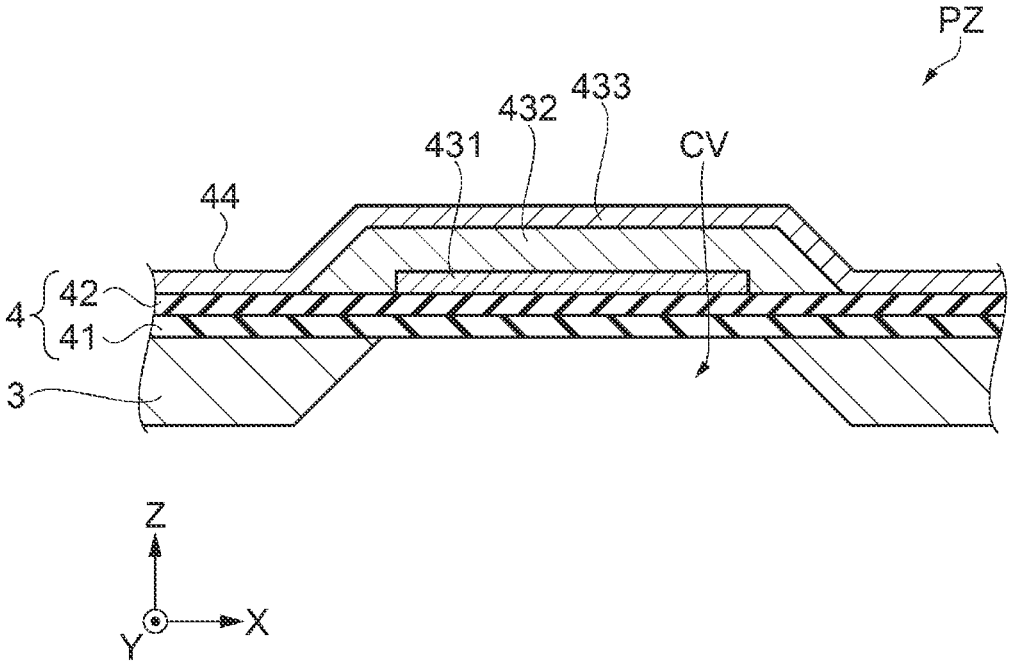
FIG. 6 is an enlarged, cross-sectional view of an area surrounding a piezoelectric element in the liquid ejecting head.

FIG. 6 is an enlarged, cross-sectional view of an area surrounding a piezoelectric element PZ. As illustrated in FIG. 6, the vibration plate 4 includes a first layer 41 and a second layer 42, which are stacked in the +Z direction in this order. The first layer 41 may be an elastic film made of silicon dioxide ($SiO_2$), which is formed by thermally oxidizing a surface of a monocrystalline silicon substrate. The second layer 42 may be a dielectric film made of zirconium oxide ($ZrO_2$), which is formed by forming a zirconium layer with spattering and thermally oxidizing the zirconium layer. Alternatively, the pressure chamber substrate 3 and the vibration plate 4 may be partly or entirely made of the same material, namely, may be integrated with each other. In other words, the vibration plate 4 may include a single layer alone.

As illustrated in FIG. 6, the piezoelectric element PZ is a stacked body in which a piezoelectric body 432 is interposed between a lower electrode 431 and an upper electrode 433 in the Z-axial direction. As viewed from the Z-axial direction, the piezoelectric element PZ is formed of a portion in which the lower electrode 431, the upper electrode 433, and the piezoelectric body 432 overlap one another. In addition, a pressure chamber CV is positioned on the −Z-directional-side surface of the piezoelectric element PZ. In this embodiment, the lower electrode 431 is a common electrode shared by a plurality of piezoelectric elements PZ, whereas the upper electrode 433 is an individual electrode provided only for a corresponding piezoelectric element PZ. However, the lower electrode 431 may be an individual electrode, whereas the upper electrode 433 may be a common electrode.

Figure 7:
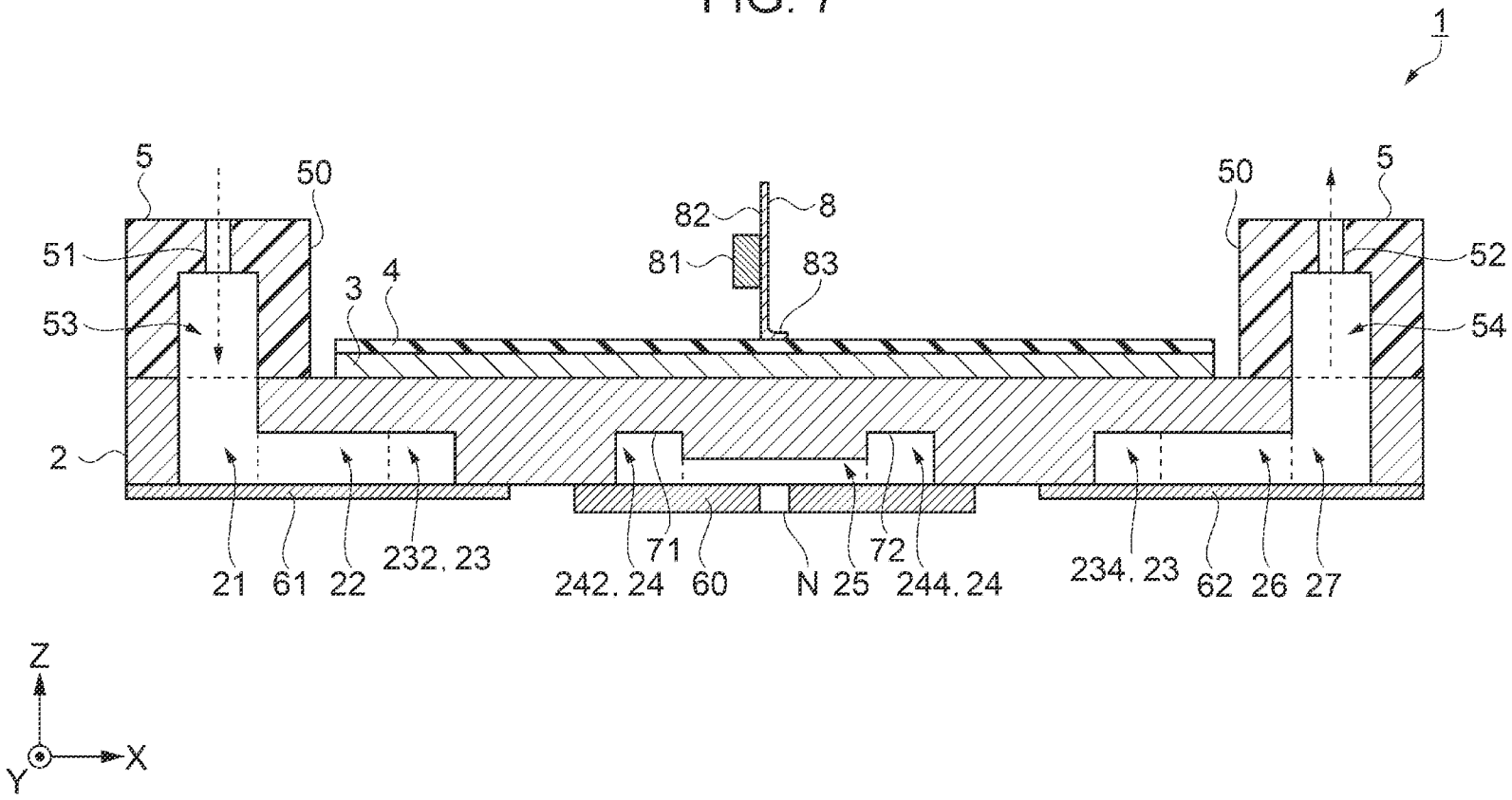
FIG. 7 is a cross-sectional view taken along line VII-VII of FIG. 4.

FIG. 7 is a cross-sectional view taken along line VII-VII of FIG. 4. As illustrated in FIGS. 2, 5, and 7, the wiring substrate 8 is mounted on the +Z-directional-side surface of the vibration plate 4. The wiring substrate 8, via which the controller 90 is electrically connected to the liquid ejecting head 1, may be a flexible wiring substrate such as a flexible printed circuit (FPC) or a flexible flat cable (FFC).

The wiring substrate 8 includes a driver circuit 81 mounted thereon which drives the piezoelectric elements PZ. The driver circuit 81 selectively transmits the drive signals COM to the piezoelectric elements PZ under the control of the control signals SI. As illustrated in FIG. 6, the driver circuit 81 transmits the drive signals COM to the upper electrode 433 of the piezoelectric element PZ via a wiring section 44 formed on the vibration plate 4.

The wiring substrate 8 includes: a main unit 82 on which the driver circuit 81 is mounted; and a connection end 83 that is angled at approximately 90° and coupled to the vibration plate 4. When the wiring substrate 8 is mounted on the vibration plate 4, the connection end 83 is substantially parallel to the vibration plate 4, but the main unit 82 is substantially vertical to the vibration plate 4.

In this embodiment, each liquid ejecting head 1 is provided with the sealing member (not illustrated), which protects a plurality of piezoelectric elements PZ and mechanically reinforces both the pressure chamber substrate 3 and the vibration plate 4. This sealing member has a recess in which the piezoelectric elements PZ are arranged. In addition, the sealing member is bonded to the +Z-directional-side surface of the vibration plate 4 with glue, for example, inside the aperture 50 of the reservoir forming substrate 5.

In this embodiment, as illustrated in FIGS. 3 to 5, when the ink is supplied from the liquid container 93 to a liquid ejecting head 1 via the supply port 51, this ink flows through the supply passage 53 and then flows into the communicating board 2 via the supply passage 21. After the ink has flown through the supply passage 21, part of the ink flows into the first pressure chamber CV1 via both the junction passage 22 and the first coupling passage 231, whereas the remaining part of the ink flows into the second pressure chamber CV2 via both the junction passage 22 and the second coupling passage 232.

The ink that has flown through the first pressure chamber CV1 flows into the nozzle passage 25 via the first communicating passage 241, whereas the ink that has flown through the second pressure chamber CV2 flows into the nozzle passage 25 via the second communicating passage 242. After having flown into the nozzle passage 25, part of the ink flows into the third pressure chamber CV3 via the third communicating passage 243, whereas the remaining part of the ink flows into the fourth pressure chamber CV4 via the fourth communicating passage 244.

The ink that has flown through the third pressure chamber CV3 flows into the junction passage 26 via the third coupling passage 233, whereas the ink that has flown through the fourth pressure chamber CV4 flows into the junction passage 26 via the fourth coupling passage 234. After having flown into the junction passage 26, the ink flows through the ejection passage 27 and the ejection passage 54 in this order and is discharged to the outside via the ejection port 52.

When the first piezoelectric element PZ1 is driven in response to the drive signal COM, part of the ink filled in the first pressure chamber CV1 flows through the first communicating passage 241 and the nozzle passage 25 in this order and is then discharged to the outside via the nozzle N. Likewise, when the second piezoelectric element PZ2 is driven in response to the drive signal COM, part of the ink filled in the second pressure chamber CV2 flows through the second communicating passage 242 and the nozzle passage 25 in this order and is then discharged to the outside via the nozzle N.

When the third piezoelectric element PZ3 is driven in response to the drive signal COM, part of the ink filled in the third pressure chamber CV3 flows through the third communicating passage 243 and the nozzle passage 25 in this order and is then discharged to the outside via the nozzle N. Likewise, when the fourth piezoelectric element PZ4 is driven in response to the drive signal COM, part of the ink filled in the fourth pressure chamber CV4 flows through the fourth communicating passage 244 and the nozzle passage 25 in this order and is then discharged to the outside via the nozzle N.

In this embodiment, when discharging the ink via the nozzle N, the driver circuit 81 may transmit drive signals COM having substantially the same waveform to the first piezoelectric element PZ1 to the fourth piezoelectric element PZ4 related to the nozzle N. However, for the purpose of maintaining the performance of ejecting ink via the nozzle N, the driver circuit 81 may transmit drive signals COM having different waveforms.

In this embodiment, each liquid ejecting head 1 discharges the ink from four pressure chambers CV (first pressure chamber CV1, second pressure chamber CV2, third pressure chamber CV3, and fourth pressure chamber CV4) to the outside via a nozzle N. In this case, each liquid ejecting head 1 can improve the ink ejecting performance by increasing the amount of ink to be discharged via a nozzle N. This configuration can discharge ink appropriately, especially when the ink is viscous or made up of large-diameter particles, for example, as opposed to a configuration in which ink is discharged from a single pressure chamber via a nozzle N.

Figure 8:
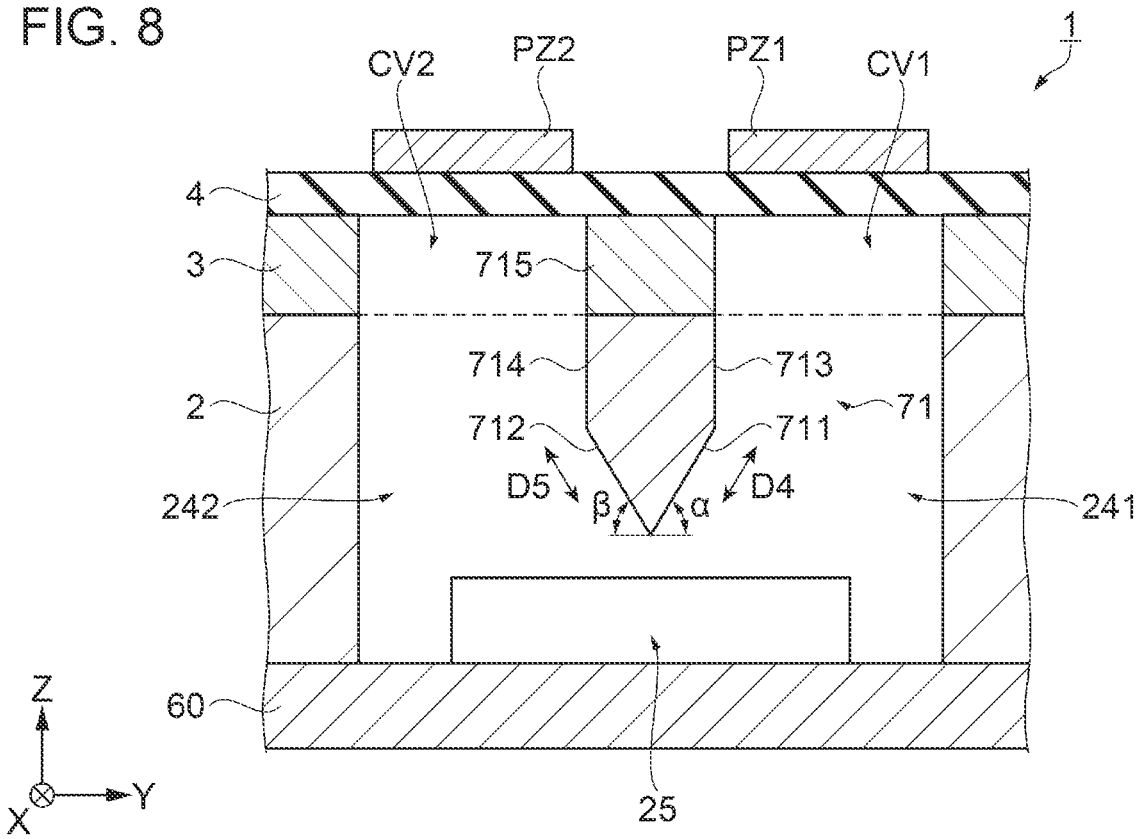
FIG. 8 is a cross-sectional view taken along line VIII-VIII of FIG. 4.
Figure 9:
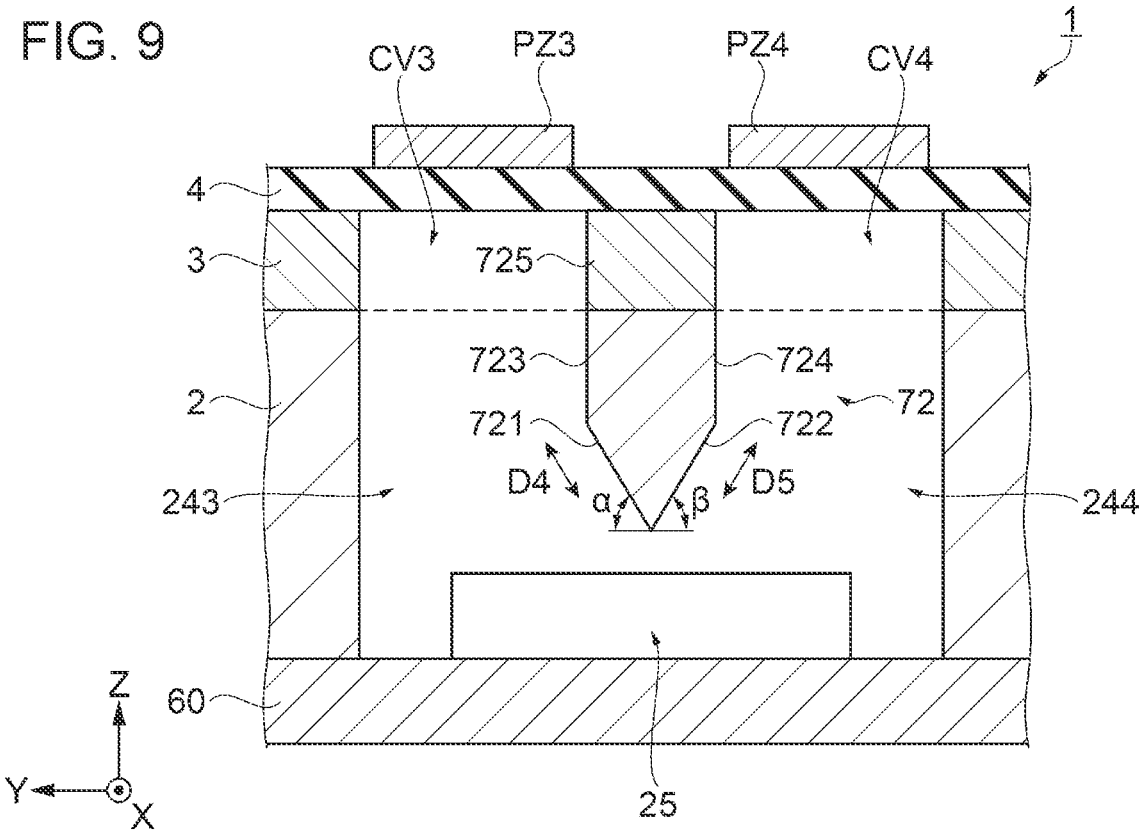
FIG. 9 is a cross-sectional view taken along line IX-IX of FIG. 4.

FIG. 8 is a cross-sectional view taken along line VIII-VIII of FIG. 4. More specifically, FIG. 8 is a cross-sectional view of a bulkhead 71 in the liquid ejecting head 1 as viewed from the +X direction. FIG. 9 is a cross-sectional view taken along line IX-IX of FIG. 4. More specifically, FIG. 9 is a cross-sectional view of a bulkhead 72 in the liquid ejecting head 1 as viewed from the −X direction.

In this embodiment, as illustrated in FIGS. 3, 4, 7, and 8, the liquid ejecting head 1 is provided with the bulkhead 71 that extends in both the −Z direction and the X-axial direction. The bulkhead 71 is disposed within the space that leads to the nozzle passage 25 and is defined between the first communicating passage 241 and the second communicating passage 242, both of which extend in the Z-axial direction (third direction).

As illustrated in FIG. 8, the bulkhead 71 includes a pressure-chamber-side bulkhead 715 that separates the first pressure chamber CV1 from the second pressure chamber CV2. In addition, the bulkhead 71 includes a first communicating-passage inner wall surface 713 that extends in the Z-axial direction (third direction). The first communicating-passage inner wall surface 713 serves as the inner wall surface of the first communicating passage 241 positioned on the side of the second communicating passage 242. Likewise, the bulkhead 71 further includes a second communicating-passage inner wall surface 714 that extends in the Z-axial direction (third direction). The second communicating-passage inner wall surface 714 serves as the inner wall surface of the second communicating passage 242 positioned on the side of the first communicating passage 241.

As viewed from the X-axial direction (second direction), as illustrated in FIG. 8, the bulkhead 71 includes a first inclined surface 711 on the inner wall surface of the first communicating passage 241 positioned on the side of the second communicating passage 242. The first inclined surface 711 extends in a direction, referred to below as a fourth direction D4, diagonally intersecting the Y-axial direction (first direction) and the Z-axial direction (third direction). The first inclined surface 711 is joined to the first communicating-passage inner wall surface 713.

As viewed from the X-axial direction (second direction), as illustrated in FIG. 8, the bulkhead 71 further includes a second inclined surface 712 on the inner wall surface of the second communicating passage 242 positioned on the side of the first communicating passage 241. The second inclined surface 712 extends in a direction, referred to below as a fifth direction D5, diagonally intersecting the Y-axial direction (first direction), the Z-axial direction (third direction), and the fourth direction D4. The second inclined surface 712 is joined to the second communicating-passage inner wall surface 714. As illustrated in FIG. 8, the second inclined surface 712 is also joined to the first inclined surface 711.

In this embodiment, as illustrated in FIGS. 3, 4, 7, and 9, the liquid ejecting head 1 is provided with the bulkhead 72 within the space that leads to the nozzle passage 25 and is defined between the third communicating passage 243 and the fourth communicating passage 244, both of which extend in the Z-axial direction (third direction). The bulkhead 72 extends in both the −Z direction and the X-axial direction.

As illustrated in FIG. 9, the bulkhead 72 includes a pressure-chamber-side bulkhead 725 that separates the third pressure chamber CV3 from the fourth pressure chamber CV4. In addition, the bulkhead 72 includes a third communicating-passage inner wall surface 723 that extends in the Z-axial direction (third direction). The third communicating-passage inner wall surface 723 serves as the inner wall surface of the third communicating passage 243 positioned on the side of the fourth communicating passage 244. Likewise, the bulkhead 72 further includes a fourth communicating-passage inner wall surface 724 that extends in the Z-axial direction (third direction). The fourth communicating-passage inner wall surface 724 serves as the inner wall surface of the fourth communicating passage 244 positioned on the side of the third communicating passage 243.

As viewed from the X-axial direction (second direction), as illustrated in FIG. 9, the bulkhead 72 includes a third inclined surface 721 on the inner wall surface of the third communicating passage 243 positioned on the side of the fourth communicating passage 244. The third inclined surface 721 extends in the fourth direction D4, which diagonally intersects the Y-axial direction (first direction) and the Z-axial direction (third direction). The third inclined surface 721 is joined to the third communicating-passage inner wall surface 723.

As viewed from the X-axial direction (second direction), as illustrated in FIG. 9, the bulkhead 72 includes a fourth inclined surface 722 on the inner wall surface of the fourth communicating passage 244 positioned on the side of the third communicating passage 243. The fourth inclined surface 722 extends in the fifth direction D5, which diagonally intersects the Y-axial direction (first direction), the Z-axial direction (third direction), and the fourth direction D4. The fourth inclined surface 722 is joined to the fourth communicating-passage inner wall surface 724. As illustrated in FIG. 9, the fourth inclined surface 722 is also joined to the third inclined surface 721.

In this embodiment, as illustrated in FIGS. 8 and 9, when the bulkheads 71 and 72 are viewed from the X-axial direction (second direction), the fourth direction D4 forms an inclination angle $\alpha$ ($\approx 60°$) with the Y-axial direction (first direction). Likewise, the fifth direction D5 forms an inclination angle $\beta$ ($\approx 60°$) with the Y-axial direction (first direction). It should be noted that each of the inclination angle $\alpha$ between the fourth direction D4 and the Y-axial direction (first direction) and the inclination angle $\beta$ between the fifth direction D5 and the Y-axial direction is not limited to 60°. Alternatively, each of the inclination angles $\alpha$ and $\beta$ may be in the range from 30 to 70°.

Figure 10:
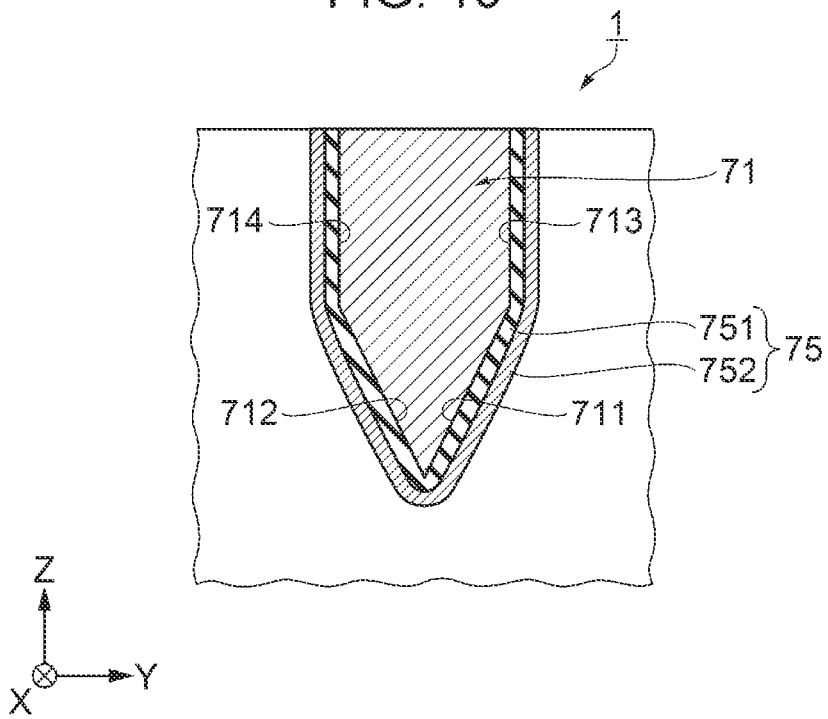
FIG. 10 is an enlarged sectional view of a protective film of a bulkhead in the liquid ejecting head.

FIG. 10 is an enlarged sectional view of a protective film 75 of the bulkhead 71. In this embodiment, the protective film 75 is formed on the outer surface of the bulkhead 71. More specifically, the protective film 75 is formed on the first inclined surface 711, the second inclined surface 712, the first communicating-passage inner wall surface 713, and the second communicating-passage inner wall surface 714. In this embodiment, protective films 75 are formed on the bulkhead 71 as well as each passage formed in the communicating board 2.

The protective film 75 includes: a first layer 751 formed on the outer surface of the bulkhead 71; and a second layer 752 formed on the outer surface of the first layer 751. The first layer 751 may be made of an oxide of silicon (Si), whereas the second layer 752 may be made of an oxide ($TaO_x$) of tantalum (Ta).

In this embodiment, the communicating board 2 provided with the bulkhead 71 may have a base material made of unoxidized silicon (Si) such as monocrystalline silicon, as described above. The first layer 751 may be made of an oxide of silicon (Si) such as silicon dioxide ($SiO_2$) or silicon monoxide (SiO). The second layer 752 may be made of an oxide ($TaO_x$) of tantalum (Ta) such as tantalum oxide ($TaO_3$) or tantalum pentoxide ($Ta_2O_5$). Alternatively, the second layer 752 may be made of an oxide of hafnium ($HfO_x$), diamond-like carbon (DLC), or aluminum oxide ($AL_2O_3$), instead of an oxide of tantalum ($TaO_x$).

In this embodiment, the first layer 751 may be formed by subjecting a silicon substrate of the bulkhead 71 to a thermal oxidation process. More specifically, the silicon substrate, such as a silicon wafer, may be placed inside a baking furnace. In this case, the inner atmosphere of the baking furnace may be adjusted to an oxygen atmosphere. Then, the silicon substrate may be subjected to a thermal process at 200° C., for example. As a result, oxygen in the baking furnace may be bonded to the silicon contained in the silicon substrate to form the first layer 751 on the outer surface of the silicon substrate of the bulkhead 71. In this case, the thickness of the first layer 751 may be in the range from 1 to 100 nm.

The second layer 752 may be formed on the outer surface of the first layer 751 through atomic layer deposition (ALD). More specifically, the silicon substrate on which the first layer 751 has been formed in the above manner may be removed from the baking furnace, and then may be placed inside an ALD deposition apparatus, in which tantalum may be applied to the outer surface of the first layer 751 so that the second layer 752 may be formed on the outer surface of the first layer 751. In this case, the thickness of the second layer 752 may be in the range from 1 to 50 nm. Alternatively, the second layer 752 may be formed by another thin-film forming method, such as plasma chemical vapor deposition (CVD), instead of ALD. In this way, the bulkhead 71 on which the first layer 751 and the second layer 752 are stacked in this order is formed.

With reference to FIG. 4 again, a configuration and operation in which the ink is supplied to or from each liquid ejecting head 1 according to this embodiment via the ejection passage 54 and the supply passage 53 will be described below. It should be noted that this description is mainly focused on the circulation mechanism 94. As illustrated in FIG. 4, the passage in the liquid ejecting head 1 includes, as constituting elements or units, a plurality of basic passage configurations described above, which are arrayed at predetermined intervals in the Y-axial direction, in accordance with the number of nozzles N. The passage including the plurality of basic passage configurations is coupled to both the supply passage 21 and the ejection passage 27, each of which serves as a common passage. In other words, the passage including the plurality of basic passage configurations is coupled to both the supply passage 53 and the ejection passage 54, each of which serves as a common passage.

Each of the supply passage 21 and the supply passage 53 stores ink to be supplied to the passage including the plurality of basic passage configurations. Each of the ejection passage 27 and the ejection passage 54 stores ink that has not been used by the liquid ejecting head 1 and will be discharged via the passage including the plurality of basic passage configurations.

Each of the supply passage 53 and the ejection passage 54 is coupled to the circulation mechanism 94, which supplies the ink to the liquid ejecting head 1 via the supply passage 53 and collects the ink discharged from the liquid ejecting head 1 via the ejection passage 54, for the sake of resupplying the ink to the liquid ejecting head 1 via the supply passage 53. The circulation mechanism 94 includes a first supply pump 941, a second supply pump 942, a storage container 943, a collecting passage 944, and a supply passage 945.

The first supply pump 941 is used to supply the ink contained in the liquid container 93 to the storage container 943, which is a sub-tank that temporarily stores the ink supplied from the liquid container 93. The collecting passage 944 is coupled to both the ejection passage 54 and the storage container 943. Via the ejection passage 54 and the collecting passage 944, the ink is collected in the storage container 943.

The ink stored in the liquid container 93 is supplied to the storage container 943 by the first supply pump 941. In addition, the ink that has been discharged from the liquid ejecting head 1 via the passages in each basic passage configuration, the ejection passage 54, and the collecting passage 944 is supplied to the storage container 943 via the collecting passage 944. The second supply pump 942 is used to force the ink stored in the storage container 943 into the liquid ejecting head 1. The supply passage 945 is coupled to both the supply passage 53 and the storage container 943. Via the supply passage 945 and the supply passage 53, the ink stored in the storage container 943 is supplied to the liquid ejecting head 1.

Some effects of the first embodiment described above effects will be described below.

According to this embodiment, a liquid ejecting head 1 is provided with a bulkhead 71 that extends in both the −Z direction and the X-axial direction. The bulkhead 71 is disposed within a space that leads to a nozzle passage 25 and is defined between a first communicating passage 241 and a second communicating passage 242, both of which extend in the Z-axial direction (third direction). An inner wall surface of the first communicating passage 241 positioned on a side of the second communicating passage 242 includes a first inclined surface 711, which extends in a fourth direction D4 diagonally intersecting the Y-axial direction (first direction) and the Z-axial direction (third direction). Likewise, an inner wall surface of the second communicating passage 242 positioned on a side of the first communicating passage 241 includes a second inclined surface 712, which extends in a fifth direction D5 diagonally intersecting the Y-axial direction (first direction), the Z-axial direction (third direction), and the fourth direction D4.

The above configuration, when a first piezoelectric element PZ1 is driven, discharges part of ink filled in a first pressure chamber CV1 via the first communicating passage 241, the nozzle passage 25, and a nozzle N in this order. Likewise, when a second piezoelectric element PZ2 is driven, the configuration discharges part of ink filled in a second pressure chamber CV2 via the second communicating passage 242, the nozzle passage 25, and the nozzle N in this order. If the end of the bulkhead 71 is disposed in substantially parallel with the X-Y plane, bubbles generated in the ink flowing through the first communicating passage 241 and the second communicating passage 242 may remain around the bulkhead 71. This configuration, however, successfully causes bubbles in the ink to move smoothly in the +Z direction, thereby allowing the liquid ejecting head 1 to continue to discharge liquid efficiently.

The bulkhead 71 may include: a first inclined surface 711 that extends in the fourth direction D4; and a second inclined surface 712 that extends in the fifth direction D5. This configuration successfully causes bubbles in the ink to uniformly move between the first communicating passage 241 and the second communicating passage 242.

In the liquid ejecting head 1, the inner wall surface of the first communicating passage 241 positioned on the side of the second communicating passage 242 may include a first communicating-passage inner wall surface 713 that extends in the Z-axial direction (third direction). The first communicating-passage inner wall surface 713 is joined to the first inclined surface 711. This configuration helps bubbles in the ink move smoothly in the +Z direction.

In the liquid ejecting head 1, the first inclined surface 711 may be joined to the second inclined surface 712. This configuration helps bubbles in the ink uniformly move between the first communicating passage 241 and the second communicating passage 242.

The liquid ejecting head 1 may further include a third pressure chamber CV3, a fourth pressure chamber CV4, a third communicating passage 243, and a fourth communicating passage 244. The liquid ejecting head 1 may be provided with a bulkhead 72 that extends in both the −Z direction and the X-axial direction (second direction). The bulkhead 72 may be disposed within a space that leads to the nozzle passage 25 and is defined between the third communicating passage 243 and the fourth communicating passage 244, both of which extend in the Z-axial direction (third direction). An inner wall surface of the third communicating passage 243 positioned on a side of a fourth communicating passage 244 may include a third inclined surface 721 that extends in the fourth direction D4. Likewise, an inner wall surface of the fourth communicating passage 244 positioned on a side of a third communicating passage 243 may include a fourth inclined surface 722 that extends in the fifth direction D5.

The above configuration, when a third piezoelectric element PZ3 is driven, discharges part of ink filled in the third pressure chamber CV3 via the third communicating passage 243, the nozzle passage 25, and the nozzle N in this order. Likewise, when a fourth piezoelectric element PZ4 is driven, the configuration discharges part of ink filled in the fourth pressure chamber CV4 via the fourth communicating passage 244, the nozzle passage 25, and the nozzle N in this order. If the end of the bulkhead 72 is disposed in substantially parallel with the X-Y plane, bubbles generated in the ink flowing through the third communicating passage 243 and the fourth communicating passage 244 may remain around the bulkhead 72. This configuration, however, successfully causes bubbles in the ink to move smoothly in the +Z direction, thereby allowing the liquid ejecting head 1 to continue to discharge liquid efficiently.

In the liquid ejecting head 1, an angle between the Y-axial direction (first direction) and each of the fourth direction D4 and the fifth direction D5 may be approximately 60°. This configuration helps bubbles in the ink move smoothly in the +Z direction. Alternatively, an angle between the Y-axial direction (first direction) and each of the fourth direction D4 and the fifth direction D5 may be in a range from 30 to 70°. This configuration can also produce substantially the same effect.

In the liquid ejecting head 1, a protective film 75 may be formed on an outer surface of the bulkhead 71. More specifically, the protective film 75 may be formed on the first inclined surface 711, the second inclined surface 712, the first communicating-passage inner wall surface 713, and the second communicating-passage inner wall surface 714. Moreover, the protective film 75 may include: a first layer 751; and a second layer 752 formed on an outer surface of the first layer 751. The first layer 751 may be made of an oxide of silicon, whereas the second layer 752 may be made of an oxide of tantalum.

The above configuration helps to protect the bulkhead 71 from damage. Thus, forming the protective film 75 in the above manner helps to protect a portion between the first inclined surface 711 and the second inclined surface 712 by rounding this portion, especially when the first inclined surface 711 is joined to the second inclined surface 712 at an acute angle. Consequently, it is possible to improve the resistance of the bulkheads 71 and 72 to ink and the strength of the bond between layers.

In the liquid ejecting head 1, the first layer 751 may be made of an oxide of silicon, whereas the second layer 752 may be made of an oxide of hafnium, diamond-like carbon, or aluminum oxide. This configuration also helps to protect a portion between the first inclined surface 711 and the second inclined surface 712 by rounding this portion, especially when the first inclined surface 711 is joined to the second inclined surface 712 at an acute angle. Consequently, it is possible to improve the resistance of the bulkheads 71 and 72 to ink and the strength of the bond between layers.

According to this embodiment, the liquid ejecting apparatus 100 includes: the above liquid ejecting head 1; and a controller 90 that controls an ink ejecting operation of the liquid ejecting head 1.

The above configuration is provided with the liquid ejecting head 1 that causes bubbles in ink to move smoothly in the +Z direction, and thus provides a liquid ejecting apparatus 100 that can continue to discharge liquid efficiently.

2. Second Embodiment

Figure 11:
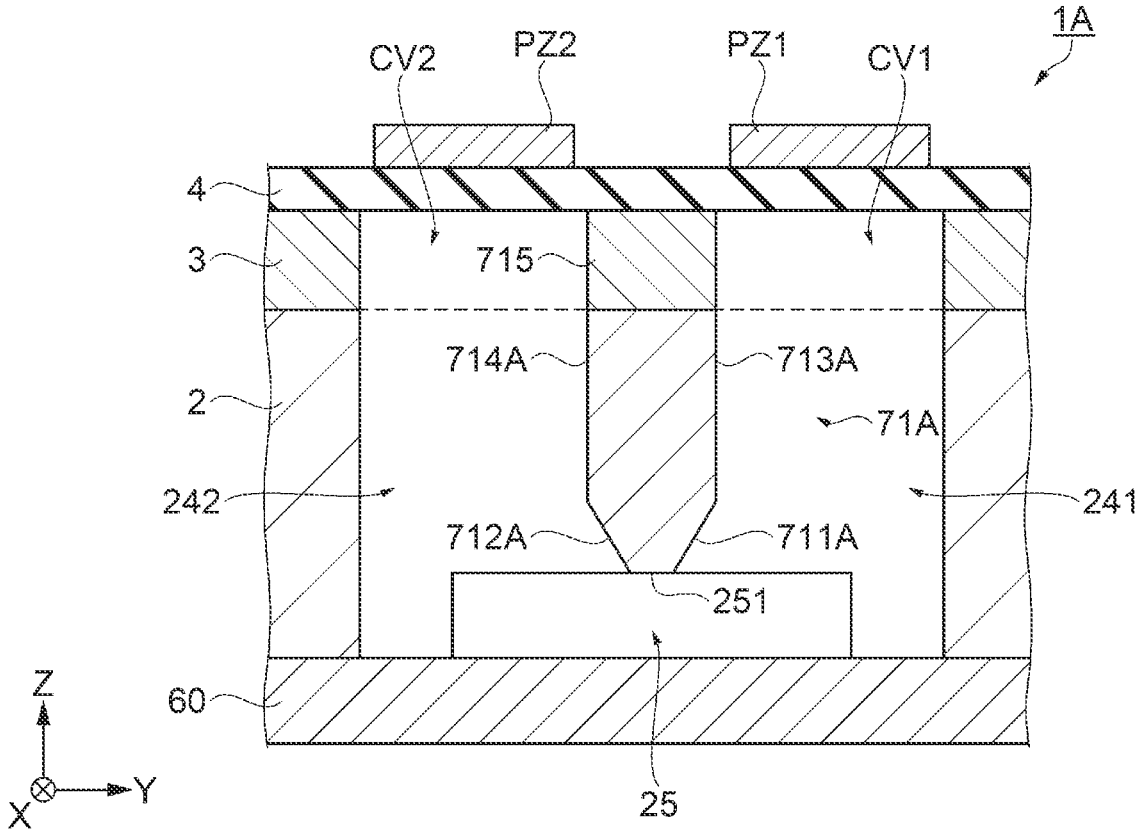
FIG. 11 is a cross-sectional view of a bulkhead in a liquid ejecting head according to a second embodiment of the present disclosure.

FIG. 11 is a cross-sectional view of a bulkhead 71A in a liquid ejecting head 1A according to a second embodiment of the present disclosure. More specifically, FIG. 11 is a cross-sectional view of the bulkhead 71A as viewed from the +X direction. FIG. 11 is related to FIG. 8, which illustrates the liquid ejecting head 1 according to the first embodiment.

The end of the bulkhead 71A in the second embodiment which protrudes in the −Z direction has a different shape from that of the bulkhead 71 in the first embodiment. Other components in the second embodiment are substantially the same as those in the first embodiment. The description below will be mainly focused on a configuration different from that of the first embodiment, and the others will not be described. In FIG. 11, the same references are given to components that are identical to those in the first embodiment.

As illustrated in FIG. 11, the bulkhead 71A includes a pressure-chamber-side bulkhead 715, a first communicating-passage inner wall surface 713A, a second communicating-passage inner wall surface 714A, a first inclined surface 711A, a second inclined surface 712A, and a nozzle-passage inner wall surface 251. The first communicating-passage inner wall surface 713A and the second communicating-passage inner wall surface 714A of the bulkhead 71A are longer in the −Z direction than the first communicating-passage inner wall surface 713 and the second communicating-passage inner wall surface 714 of the bulkhead 71 in the first embodiment. Furthermore, the lower surfaces of the first inclined surface 711A and the second inclined surface 712A are in contact with the nozzle-passage inner wall surface 251, which corresponds to a +Z-directional inner circumferential surface of a nozzle passage 25.

In this embodiment, the end of the bulkhead 71A is provided with the first inclined surface 711A that extends in the fourth direction D4, the second inclined surface 712A that extends in the fifth direction D5, and the nozzle-passage inner wall surface 251. Further, in this embodiment, the nozzle-passage inner wall surface 251 of the bulkhead 71A extends in the X-axial direction (second direction) and is joined to both the first inclined surface 711A and the second inclined surface 712A. In this case, the nozzle-passage inner wall surface 251 is substantially parallel to the X-Y plane.

Some effects of the second embodiment described above will be described below.

According to the second embodiment, a bulkhead 71A of a liquid ejecting head 1A is provided with a nozzle-passage inner wall surface 251, which extends in the X-axial direction (second direction) and is joined to both a first inclined surface 711A and a second inclined surface 712A. This configuration, even if ink flowing through a first communicating passage 241 and a second communicating passage 242 generates bubbles, successfully causes these bubbles to move smoothly in the +Z direction along both the first inclined surface 711A and the second inclined surface 712A of the bulkhead 71A without leaving the bubbles around the nozzle-passage inner wall surface 251, which extends in the X-axial direction (second direction).

3. Third Embodiment

Figure 12:
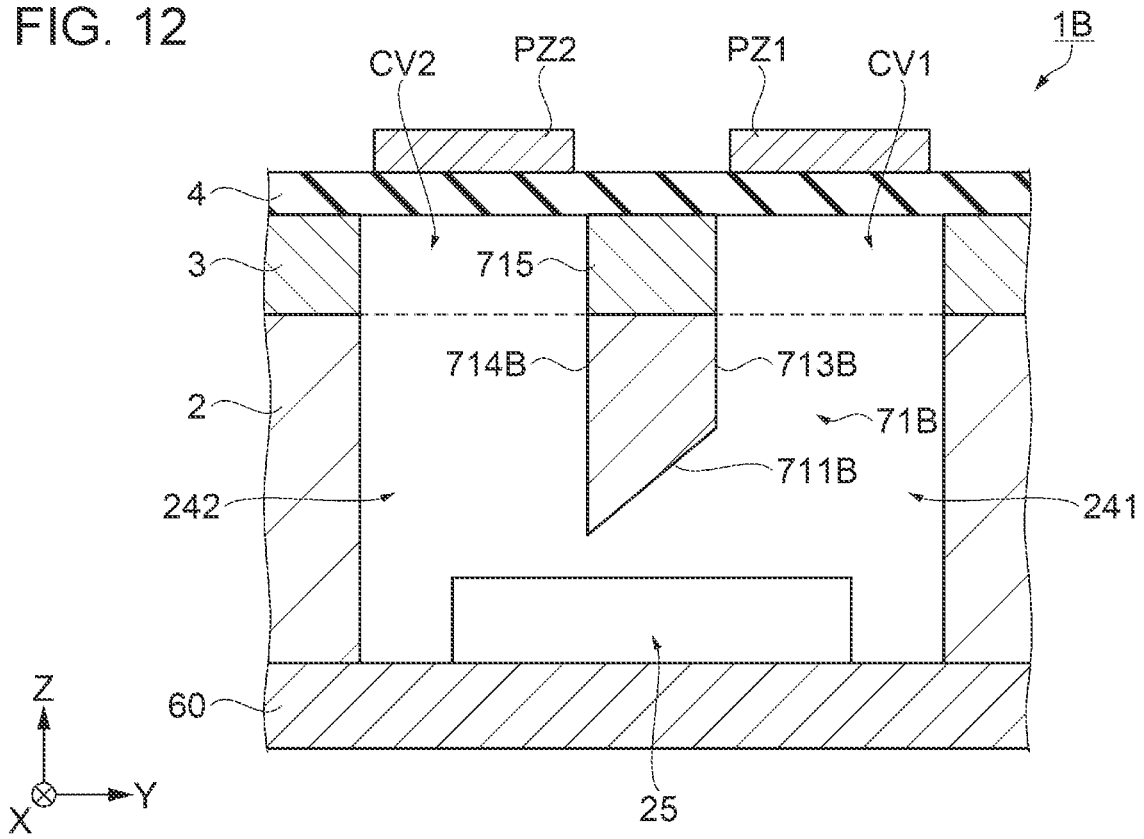
FIG. 12 is a cross-sectional view of a bulkhead in a liquid ejecting head according to a third embodiment of the present disclosure.

FIG. 12 is a cross-sectional view of a bulkhead 71B in a liquid ejecting head 1B according to a third embodiment of the present disclosure. More specifically, FIG. 12 is a cross-sectional view of the bulkhead 71B as viewed from the +X direction. FIG. 12 is related to FIG. 8, which illustrates the liquid ejecting head 1 according to the first embodiment.

The end of the bulkhead 71B in the third embodiment which protrudes in the −Z direction has a different shape from that of the bulkhead 71 in the first embodiment. Other components in the second embodiment are substantially the same as those in the first embodiment. The description below will be mainly focused on a configuration different from that of the first embodiment, and the others will not be described. In FIG. 12, the same references are given to components that are identical to those in the first embodiment.

As illustrated in FIG. 12, the bulkhead 71B includes a pressure-chamber-side bulkhead 715, a first communicating-passage inner wall surface 713B, a second communicating-passage inner wall surface 714B, and a first inclined surface 711B. The bulkhead 71B in this embodiment is equivalent to the bulkhead 71 in the first embodiment except the second inclined surface 712. More specifically, in the bulkhead 71B, the first inclined surface 711B, which further extends in the fourth direction D4 compared to the first inclined surface 711 in the first embodiment, is joined to the second communicating-passage inner wall surface 714B, which further extends in the −Z direction compared to the second communicating-passage inner wall surface 714 in the first embodiment. In this embodiment, the first inclined surface 711B of the bulkhead 71B is joined to both the first communicating-passage inner wall surface 713B and the second communicating-passage inner wall surface 714B.

Some effects of the third embodiment described above will be described below.

According to the third embodiment, a bulkhead 71B in a liquid ejecting head 1B includes a first communicating-passage inner wall surface 713B, a second communicating-passage inner wall surface 714B, and a first inclined surface 711B that is joined to both the first communicating-passage inner wall surface 713B and the second communicating-passage inner wall surface 714B. This configuration, even if ink flowing through a first communicating passage 241 and a second communicating passage 242 generates bubbles, successfully causes these bubbles to move smoothly in the +Z direction along the first inclined surface 711B.

4. Fourth Embodiment

Figure 13:
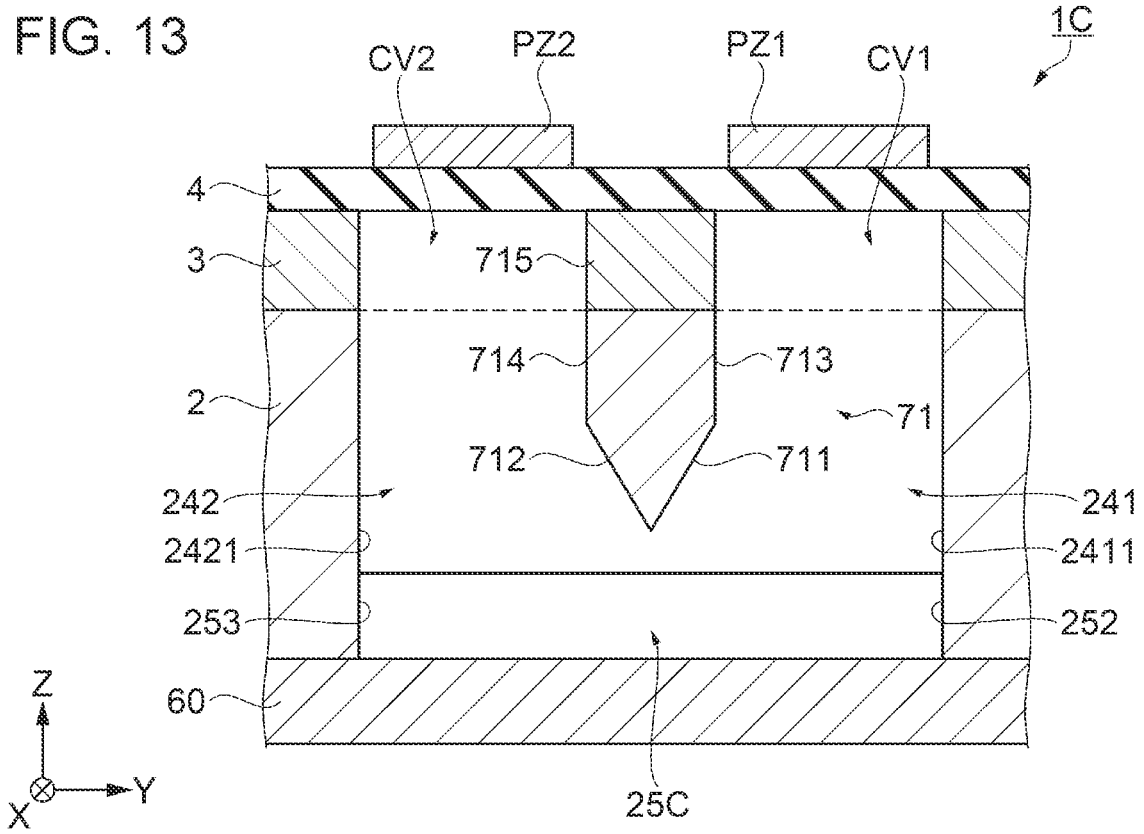
FIG. 13 is a cross-sectional view of a nozzle passage in a liquid ejecting head according to a fourth embodiment of the present disclosure.

FIG. 13 is a cross-sectional view of a nozzle passage 25C in a liquid ejecting head 1C according to a fourth embodiment of the present disclosure. More specifically, FIG. 13 is a cross-sectional view of the nozzle passage 25C within the area surrounding a bulkhead 71 as viewed from the −X direction.

As illustrated in FIG. 13, the nozzle passage 25C in this embodiment differs from the nozzle passage 25 in the first embodiment because the nozzle passage 25C is further widened in the Y-axial direction (first direction) compared to the nozzle passage 25. Other components in the fourth embodiment are substantially the same as those in the first embodiment. The description below will be mainly focused on a configuration different from that of the first embodiment, and the others will not be described. In FIG. 13, the same references are given to components that are identical to those in the first embodiment.

The liquid ejecting head 1C includes a first communicating passage 241 and a second communicating passage 242, both of which extend in the Z-axial direction (third direction). As viewed from the X-axial direction, the first communicating passage 241 has a first communicating-passage outer wall surface 2411 as its outer surface, whereas the second communicating passage 242 has a second communicating-passage outer wall surface 2421 as its outer surface.

As viewed from the X-axial direction, the nozzle passage 25C that extends in the Y-axial direction (first direction) has a first nozzle-passage outer wall surface 252 as its +Y-directional outer surface and also has a second nozzle-passage outer wall surface 253 as its −Y-directional outer surface.

In this embodiment, the first nozzle-passage outer wall surface 252 is evenly joined to the first communicating-passage outer wall surface 2411 without any step therebetween in the X-axial direction. Likewise, the second nozzle-passage outer wall surface 253 is evenly joined to the second communicating-passage outer wall surface 2421 without any step therebetween in the X-axial direction.

Some effects of the fourth embodiment described above will be described below.

According to the fourth embodiment, a liquid ejecting head 1C includes a first nozzle-passage outer wall surface 252 and a second nozzle-passage outer wall surface 253. The first nozzle-passage outer wall surface 252 is evenly joined to a first communicating-passage outer wall surface 2411 without any step therebetween in the X-axial direction. Likewise, the second nozzle-passage outer wall surface 253 is evenly joined to a second communicating-passage outer wall surface 2421 without any step therebetween in the X-axial direction. This configuration, when ink flows from a first pressure chamber CV1 into the first communicating passage 241, successfully causes this ink to smoothly flow into the nozzle passage 25C. Likewise, when ink flows from a second pressure chamber CV2 into the second communicating passage 242, the configuration successfully causes this ink to smoothly flow into the nozzle passage 25C.

5. Modification 1

In the first to fourth embodiments described above, each of the liquid ejecting heads 1, 1A, 1B, and 1C includes, as basic passage components, four pressure chambers CV that lead to a nozzle N and are arrayed in two rows in the Y-axial direction, or in an extension direction of a nozzle array Ln. Out of these pressure chambers CV, two are positioned within a −X-directional area, and the others are positioned within a +X-directional area. The pressure chambers CV within the −X-directional area are positioned adjacent to the respective pressure chambers CV within the +X-directional area. However, the present disclosure is not limited to such a configuration. Alternatively, a liquid ejecting head may be modified such that two of the pressure chambers CV arrayed in a row within the −X-directional area and one of the other pressure chambers CV array in a row within the +X-directional area lead to a nozzle N. Alternatively, a liquid ejecting head may be modified such that three of the pressure chambers CV arrayed in a row within the −X-directional area and three of the other pressure chambers CV arrayed in a row within the +X-directional area lead to a nozzle N. Alternatively, a liquid ejecting head may be modified such that only two of the pressure chambers CV arrayed in a row within the −X-directional area lead to a nozzle N. Alternatively, a liquid ejecting head may be modified such that only three of the pressure chambers CV arrayed in a row within the −X-directional area lead to a nozzle N. In short, a liquid ejecting head has only to be configured such that a plurality of pressure chambers CV arrayed in the Y-axial direction (first direction) may lead to a nozzle N.

6. Modification 2

In the first embodiment described above, the protective film 75 is formed on the outer surface of the bulkhead 71. More specifically, the protective film 75 may be formed on the first inclined surface 711, the second inclined surface 712, the first communicating-passage inner wall surface 713, and the second communicating-passage inner wall surface 714. However, the present disclosure is not limited to such a configuration. Alternatively, the protective film 75 may be formed only on the first inclined surface 711. This configuration also helps to protect the first inclined surface 711 from damage.

7. Modification 3

In the first to fourth embodiments described above, the liquid ejecting apparatus 100 is of a serial type in which the liquid ejecting head 1, 1A, 1B, and 1C, respectively, reciprocate across the width of a medium P. However, the present disclosure is not limited to such a configuration. Alternatively, a liquid ejecting apparatus according to a modification may be of a line type in which a plurality of nozzles N are arrayed across the width of a medium P.

What is claimed is:

1. A liquid ejecting head comprising:

a nozzle array including a plurality of nozzles via which liquid is to be discharged, the nozzles being arrayed in a first direction;

a nozzle passage leading to a predetermined nozzle out of the plurality of nozzles, the nozzle passage extending in a second direction, the second direction intersecting the first direction;

a first pressure chamber in which pressure is applied to the liquid;

a second pressure chamber in which pressure is applied to the liquid, the second pressure chamber being disposed adjacent to the first pressure chamber in the first direction;

a first communicating passage via which the first pressure chamber communicates with an interior of the nozzle passage, the first communicating passage extending in a third direction, the third direction intersecting both the first direction and the second direction at substantially right angles; and a second communicating passage via which the second pressure chamber communicates with the interior of the nozzle passage, the second communicating passage extending in the third direction, wherein, as viewed from the second direction, an inner wall surface of the first communicating passage positioned on a side of the second communicating passage includes a first inclined surface that extends in a fourth direction, the fourth direction intersecting both the first direction and the third direction.

2. The liquid ejecting head according to claim 1, wherein as viewed from the second direction, the inner wall surface of the first communicating passage further includes a first communicating-passage inner wall surface that extends in the third direction, and the first inclined surface is joined to the first communicating-passage inner wall surface.

3. The liquid ejecting head according to claim 2, wherein as viewed from the second direction, an inner wall surface of the second communicating passage positioned on a side of the first communicating passage includes a second inclined surface that extends in a fifth direction, the fifth direction interesting the first direction, the third direction, and the fourth direction.

4. The liquid ejecting head according to claim 3, wherein the first inclined surface is joined to the second inclined surface.

5. The liquid ejecting head according to claim 4, wherein an inner wall surface of the nozzle passage includes a nozzle-passage inner wall surface, and the nozzle-passage inner wall surface extends in the second direction and is joined to both the first inclined surface and the second inclined surface.

6. The liquid ejecting head according to claim 2, wherein as viewed from the second direction, an inner wall surface of the second communicating passage includes a second communicating passage inner wall that extends in the third direction, and the first inclined surface is bonded to both the first communicating-passage inner wall surface and the second communicating-passage inner wall surface.

7. The liquid ejecting head according to claim 1, wherein as viewed from the second direction, an outer wall surface of the first communicating passage includes a first communicating-passage outer wall surface that extends in the third direction, and as viewed from the second direction, an outer wall surface of the nozzle passage includes a first nozzle-passage outer wall surface that extends in the first direction and that is joined to the first communicating-passage outer wall surface.

8. The liquid ejecting head according to claim 1, further comprising:

a third pressure chamber in which pressure is to be applied to the liquid, the third pressure chamber being positioned adjacent to the first pressure chamber in the second direction;

a fourth pressure chamber in which pressure is to be applied to the liquid, the fourth pressure chamber being positioned adjacent to the third pressure chamber in the first direction;

a third communicating passage via which the third pressure chamber communicates with the interior of the nozzle passage, the third communicating passage extending in the third direction; and a fourth communicating passage via which the fourth pressure chamber communicates with the interior of the nozzle passage, the fourth communicating passage extending in the third direction, wherein as viewed from the second direction, an inner wall surface of the third communicating passage positioned on a side of a fourth communicating passage includes a third inclined surface that extends in the fourth direction.

9. The liquid ejecting head according to claim 3, wherein as viewed from the second direction, an angle between the first direction and the fourth direction is in a range from 30 to 70°, and an angle between the first direction and the fifth direction is in a range from 30 to 70°.

10. The liquid ejecting head according to claim 1, wherein a protective film is formed on the first inclined surface.

11. The liquid ejecting head according to claim 10, wherein the protective film includes a first layer and a second layer that is formed on an outer surface of the first layer.

12. The liquid ejecting head according to claim 11, wherein the first layer is made of an oxide of silicon, and the second layer is made of an oxide of tantalum.

13. The liquid ejecting head according to claim 11, wherein the first layer is made of an oxide of silicon, and the second layer is made of an oxide of hafnium, diamond-like carbon, or aluminum oxide.

14. A liquid ejecting apparatus comprising:

the liquid ejecting head according to claim 1; and a controller that controls a liquid ejecting operation of the liquid ejecting head.

* * * * *